United States Patent [19]

Landgreen

[11] 4,291,930

[45] Sep. 29, 1981

[54] GROUND LUG FOR ELECTRICAL CONNECTOR

[75] Inventor: Eleanor A. Landgreen, Whittier, Calif.

[73] Assignee: International Telephone and Telegraph Corporation, New York, N.Y.

[21] Appl. No.: 74,728

[22] Filed: Sep. 12, 1979

[51] Int. Cl.[3] ..... H01R 4/66

[52] U.S. Cl. ..... 339/14 P; 339/222; 339/31 R

[58] Field of Search ..... 339/14 R, 14 P, 14 RP, 339/222, 19

[56] References Cited

U.S. PATENT DOCUMENTS

| | | | |
|---|---|---|---|
| 3,219,961 | 11/1965 | Bailey et al. | 339/19 |
| 3,597,716 | 8/1971 | Stuart et al. | 339/19 |
| 3,720,903 | 3/1973 | Schor | 339/19 X |

*Primary Examiner*—Eugene F. Desmond

*Attorney, Agent, or Firm*—Thomas L. Peterson

[57] ABSTRACT

An electrical connector having a grounding lug formed with an integral extension arm resiliently engaging one side of an electrical contact in the connector. A notch is formed in the extension arm which allows the arm to be readily removed so that the grounding connection between the lug and the contact may be broken when it is not needed.

9 Claims, 9 Drawing Figures

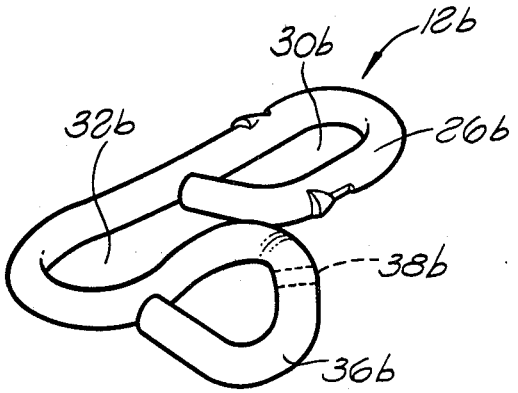
FIG. 6
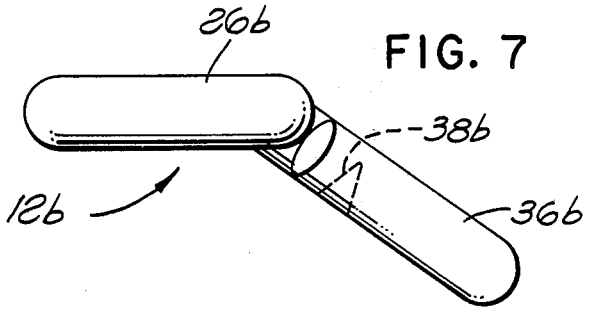
FIG. 7
FIG. 8
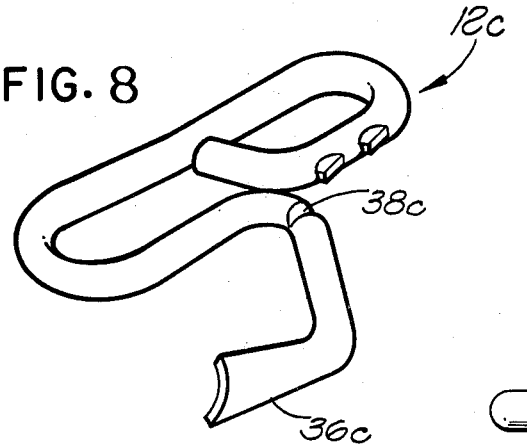
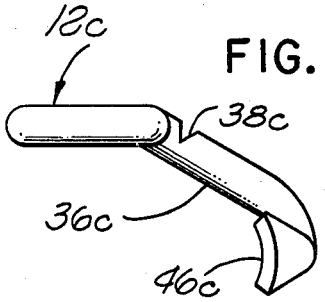
FIG. 9

GROUND LUG FOR ELECTRICAL CONNECTOR

BACKGROUND OF THE INVENTION

The present invention relates generally to an electrical connector and, more particularly, to a grounding lug for an electrical connector.

In some electrical connectors it is desirable to provide grounding for one of the contacts in the connector to the shell thereof. Such grounding connection is typically provided by mounting a grounding lug in the insulator of the connector by the use of a screw which is in contact with the shell of the connector, and by the use of a wire which is soldered at its opposite ends to an exposed rear end of the grounding lug and the ground contact in the connector. The soldering operation is time consuming and inconvenient. It has been proposed that the grounding lug be provided with an extension arm which is formed at its end with a loop which slides axially over and circumscribes the contact when the lug is mounted in the connector insulator. However, if the user does not desire to have a grounding connection between the lug and the contact, such connection may be broken only by sliding the lug off of the contact. This requires that the entire lug removed from the insulator which is also a time consuming and inconvenient operation since it requires removal of the screw which mounts the lug in the insulator.

It is, therefore, the object of the present invention to provide an improved grounding lug which provides electrical connection to a contact in the connector insulator without the requirement of soldering a wire therebetween, yet allows the electrical connection to be broken without the necessity of removing the entire lug from the insulator.

SUMMARY OF THE INVENTION

According to the principal aspect of the present invention, there is provided an electrical connector comprising an insulator containing at least one contact and a grounding lug. The grounding lug has an internal extension arm which is resiliently biased against only one side of the contact to provide electrical connection therebetween without a soldering operation. Such electrical connection may be broken without removing the grounding lug from the insulator by breaking the extension arm away from the body of the lug at a notched area thereof.

BRIEF DESCRIPTION OF THE DRAWINGS

FIG. 6 is a perspective view of a third embodiment of the grounding lug of the invention;

FIG. 7 is a rear end view of the grounding lug illustrated in FIG. 6;

FIG. 8 is a perspective view of a fourth embodiment of the grounding lug of the present invention; and FIG. 9 is a rear end view of the grounding lug illustrated in FIG. 8.

DESCRIPTION OF THE PREFERRED EMBODIMENTS

Figure 1:
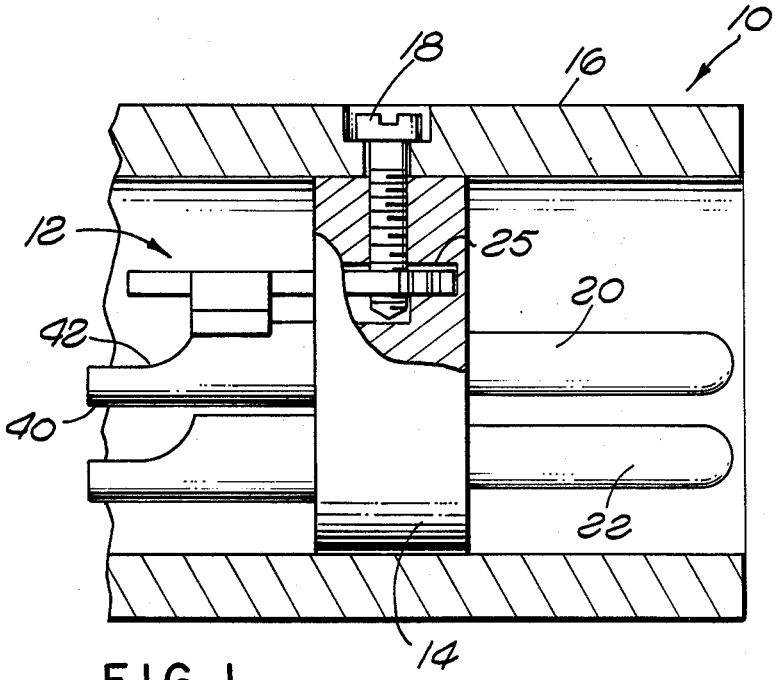
FIG. 1 is a partial longitudinal sectional view through an electrical connector member containing the novel grounding lug of the present invention.
Figure 2:
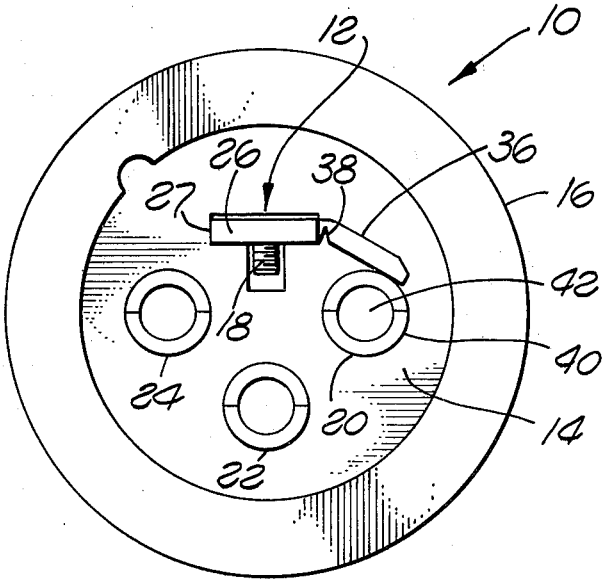
FIG. 2 is a rear end view of the connector member illustrated in FIG. 1.
Figure 3:
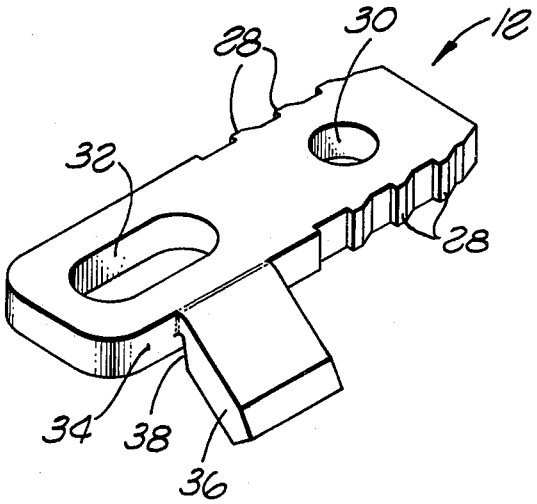
FIG. 3 is a perspective view of the grounding lug used in the connector member of FIGS. 1 and 2.

Referring now to the drawings in detail, FIGS. 1 and 2 illustrate a plug connector member generally designated 10 containing one form of the grounding lug of the present invention, generally designated 12 and best seen in FIG. 3. The connector member 10 comprises an insulator 14 mounted in a metal shell 16. The insulator is retained in the shell by means of a screw 18. The insulator contains a plurality of pin contacts 20, 22 and 24, only three being shown by way of example, if desired.

The grounding lug 12 is a stamped and formed sheet metal member having a flat body 26, the forward end of which is inserted into a relatively flat slot 27 in the insulator 14.

Barbs 28 on the sides of the body 26 serve to frictionally retain the grounding lug in the slot. An opening 30 is formed in the forward portion of the body 26. The opening is aligned with the screw 18 when the lug is fully positioned in the insulator 14 whereby the screw may be self-threaded into the opening to provide positive retention of the lug in the insulator and electrical connection between the lug and the shell 16 of the connector member 10. The electrical connection between the lug and the connector shell may be provided in a different fashion, if desired, as for example disclosed in U.S. Pat. No. 3,219,961.An elongated opening 32 is formed in the rear portion 34 of the lug body which extends rearwardly from the insulator 14 which may be utilized for connecting a wire to the lug, if desired.

In accordance with the invention, electrical connection between the grounding lug and one of the contacts in the connector, namely, the contact 20, is provided by an integral extension arm 36 which extends outwardly and downwardly from one side of the rear portion 34 of the lug body. The arm 36 extends downwardly at a predetermined angle relative to the flat body 26 and the contact 20 so that when the lug is inserted into the slot 27 in the insulator, the arm will be resiliently biased against the side of the contact body. As best seen in FIG. 2, the arm tangentially engages the contact. A notch 38 is formed in the underside of the arm 36 adjacent to the point that the arm joins to the body 26 to provide a break area whereby the extension arm 36 may be readily removed from the grounding lug in the event the user does not wish to have a grounding connection between the lug and the contact 20. It will be appreciated that such electrical connection may be readily broken because the extension arm 36 bears against only one side of the contact body and thus may be removed from the lug and the contact without removing the lug from the insulator 14.

The rear of the contact 20 which is engaged by the extension arm 36 on the grounding lug is preferably in the form of a solder pot 40 which opens upwardly as indicated at 42. The arm 36 bears against the solder pot 40 immediately in front of the opening 42 so that when solder is applied to the solder pot to affix an electrical wire thereto, the solder will extend to the joint between the contact and the extension arm by the wicking action of the solder. Thus, when a wire is being soldered to the pot 40, the extension arm 36 on the grounding lug will be simultaneously soldered to the contact 20.

Figure 4:
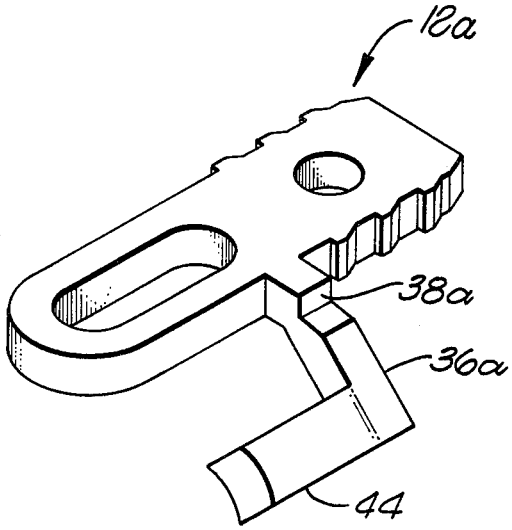
FIG. 4 is a perspective view of a second embodiment of the grounding lug of the present invention.
Figure 5:
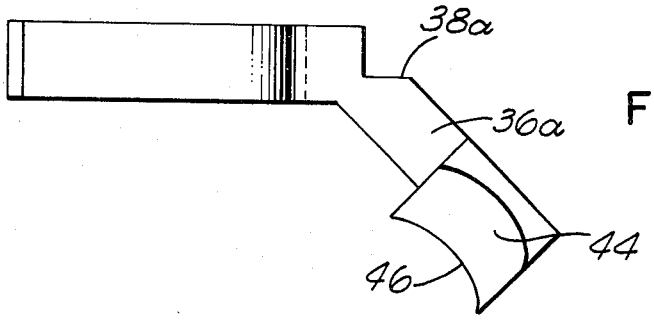
FIG. 5 is a rear end view of the grounding lug illustrated in FIG. 4.

Reference is now made to FIGS. 4 and 5 of the drawings, which illustrate a second embodiment of the grounding lug of the present invention, generally designated 12*a*. In this embodiment, the notch 38*a* is formed in the upper surface of the extension arm 36*a*, and the extension arm is formed with a rearwardly extending finger 44 having a curved inner surface 46 which is complementary with and, therefore, conforms to the curved outer surface of the rear portion of the contact 20 so that intimate electrical contact is provided therebetween over a relatively large surface area.

A further embodiment of the grounding lug of the invention is illustrated in FIGS. 6 and 7 wherein the body 26*b* of the lug 12*b* comprises a wire which is formed to provide the screw receiving opening 30*b* and wire receiving opening 32*b*. The rear of the wire is formed as a loop 36*b* which constitutes the extension arm of the grounding lug that engages the ground contact in the connector. The notch 38*b* which provides the break area for the extension arm is located at the forward end of the loop 36*b*.

The embodiment of the grounding lug illustrated in FIGS. 8 and 9, generally designated 12*c*, is formed of wire similar to the embodiment illustrated in FIGS. 6 and 7, except that the extension arm 36*c* is not formed as a loop, but rather extends rearwardly similar to the arm 44 in FIGS. 4 and 5. The arm 36*c* is provided with an arcuate inner surface 46*c* which conforms to the surface of the ground contact. The notch 38*c* in this embodiment is located in the upper surface of the loop 36*c*.

In the embodiments shown in FIGS. 4, 5, 8 and 9, each arcuate inner surface 46, 46*c* which engages the contact extends over an arc substantially less than 180°. Consequently, like the flat arm 36, the arms 36*a*, 36*c* engage only one side of the contact whereby the arms may be laterally disengaged from the contact.

From the foregoing, it will be appreciated that the grounding lug of the present invention may be formed of different conductive materials and have a variety of shapes, and in each case has the advantage that a grounding connection is automatically made with the ground contact in the connector when the grounding lug is mounted in the insulator of the connector, and such grounding connection may be broken by the user if it is not needed by simply breaking the extension arm away from the grounding lug body by use of a suitable tool, such as a screwdriver.

What is claimed is:

1. An electrical connector comprising:

an insulator containing at least one contact and a grounding lug;

a conductive shell surrounding said insulator;

said grounding lug comprising an electrically conductive body having an integral extension arm outside of said insulator resiliently biased against only one side of said contact to provide electrical connection therebetween;

said grounding lug body having a forward opening therein located within said insulator; and fastener means extending through said shell into said opening to electrically connect said grounding lug to said shell.

2. An electrical connector as set forth in claim 1 wherein:

a notch extends transversely across said extension arm to provide a break area allowing ready lateral removal of said arm from said body.

3. An electrical connector as set forth in claim 1 wherein:

said one contact embodies a solder pot outside of said insulator; and said solder pot opening at said one side of said contact engaged by said extension arm whereby solder applied to said solder pot to connect an electrical wire thereto will extend to the joint between the contact and extension arm by the wicking action of the solder.

4. An electrical connector as set forth in claim 1 wherein:

said grounding lug body also embodies a rear wire receiving opening outside of said insulator.

5. An electrical connector as set forth in claim 4 wherein:

said grounding lug comprises a wire formed to provide said extension arm and said openings.

6. An electrical connector as set forth in claim 1 wherein:

said grounding lug comprises a wire formed to provide said extension arm.

7. An electrical connector as set forth in claim 1 wherein:

said one side of said contact has an arcuate surface; and the portion of said extension arm which engages said contact having a curved surface complementary to said arcuate surface, said curved surface extending over an arc of less than 180°.

8. An electrical connector as set forth in claim 1 wherein:

said extension arm tangentially engages said contact.

9. An electrical connector as set forth in claim 2 wherein:

said notch is formed in only one surface of said extension arm.

* * * * *